US005522246A

United States Patent [19]

Simon

[11] Patent Number: 5,522,246

[45] Date of Patent: Jun. 4, 1996

[54] PROCESS FOR FORMING LIGHT-WEIGHT TUBLAR AXLES

[75] Inventor: Norina A. Simon, Grosse Pointe Farms, Mich.

[73] Assignee: U.S. Manufacturing Corporation, Fraser, Mich.

[21] Appl. No.: 423,803

[22] Filed: Apr. 19, 1995

[51] Int. Cl.[6] ..... B21C 25/08

[52] U.S. Cl. ..... 72/260; 72/266; 74/567; 74/595; 74/597; 74/607

[58] Field of Search ..... 72/260, 266, 267, 72/273, 370; 29/897.2; 74/567, 595, 597, 607

[56] References Cited

U.S. PATENT DOCUMENTS

| | | | |
|---|---|---|---|
| 2,942,728 | 6/1960 | Hilton | 72/260 |
| 5,259,268 | 11/1993 | Ebbinghaus et al. | 74/567 |
| 5,337,476 | 8/1994 | Orsini, Jr. | 74/567 |

*Primary Examiner*—Daniel C. Crane
*Assistant Examiner*—Ed Tolan
*Attorney, Agent, or Firm*—Harness, Dickey & Pierce

[57] ABSTRACT

A process for cold forming tubular axles comprises placing a tubular blank within an open ended die having a constricted die throat, and pushing the blank through the die throat with a punch. The punch is provided with a portion that presses the blank axially through the die throat. In addition, the punch has at least one extension which is closely fitted within the blank so that as the punch pushes a portion of the tube axially through the die throat, the extension is arranged within the die throat to form an annular space between the extension and the die throat. The punch extension is substantially elliptical in cross-section while the die throat is substantially circular in cross-section. Thus, the portion of the blank extruded through the space is formed with a substantially circular exterior wall and a substantially elliptical interior wall which provides diametrically opposing thicker wall sections and diametrically opposing thinner wall sections that are 90° offset relative to the tubular wall sections in the tubular axle. This provides an axle which may be arranged to correlate its thicker and thinner wall portions to the anticipated loads applied to the axle for reducing the weight of the axle without reducing its strength to accommodate such loads.

6 Claims, 2 Drawing Sheets

PROCESS FOR FORMING LIGHT-WEIGHT TUBLAR AXLES

BACKGROUND OF INVENTION

This invention relates to a process for manufacturing a lightweight, axle, useful for automotive vehicles and particularly for trucks. This manufacturing process produces axles whose wall thicknesses, in cross-section, vary so that the wall thicknesses are greater where greater load absorption is required and reduced where a lesser load is to be absorbed with the result that the weight of the axle can be reduced without reducing its strength.

Axles have been manufactured in the past by a cold forming process which involves extruding a tubular blank through the constricted die throat of a die, utilizing a punch for pushing the blank through the die throat. The punch has been formed with an annular ram surface for engaging the trailing end of the blank and pushing it towards and through the die throat. In addition, the punches have been formed with forwardly oriented extensions which are positioned within the die throat to provide annular spaces through which the blank is extruded. By appropriately manipulating the extensions which are of different diameters, portions of the wall thickness of the extruded tube can be made thicker while other portions can be made thinner. In cross-section, however, the wall thicknesses are uniform.

Examples of this type of process are disclosed in U.S. Pat. No. 4,435,972 issued Mar. 13, 1984 to Joseph A. Simon for a "Process for Forming Integral Spindle-Axle Tubes". A further example of such type process is disclosed in U.S. Pat. No. 5,105,644 issued Apr. 21, 1992 to Joseph A. Simon for a "Light Weight Drive Shaft". Other disclosures of this type of process are found in U.S. Pat. No. 5,241,848 issued Sep. 7, 1993 to Joseph A. Simon for a "Light Weight Drive Shaft" and U.S. Pat. No. 5,388,322 issued Feb. 14, 1995, to Joseph A. Simon for a "Method for Making a Shatterproof Air Bag Inflator Pressure Vessel".

The present invention is concerned with adapting or utilizing a process of the previously mentioned type, but wherein the process is changed to produce tube interior wall portions, which are generally elliptical, rather than circular, in cross-sectional shape. Thus, the cross-sectional shape of such tube portions are varied or non-uniform in thickness. The tube can be oriented, when it is used, in a way that accommodates applied loads while nevertheless reducing the metal and, therefore, the weight of the tube in areas which are not subject to high loads.

SUMMARY OF INVENTION

This invention contemplates a method for manufacturing a reduced weight tube of the type which may be used as an axle in automotive vehicles, such as trucks and the like. Unlike a conventional tube which is formed with a circular exterior wall and a circular, coaxial interior wall to provide a uniform annular, cross-sectional thickness, the tube formed by the present method contemplates forming a substantially circular exterior surface with a coaxial, substantially elliptical interior wall surface. This configuration provides a non-uniform or varying cross-sectional wall thickness which, when properly arranged, provides sufficient wall thicknesses where necessary to accommodate large forces and reduced wall thicknesses in the areas needed to accommodate lesser forces. For example, the cross-sectional wall thickness of the tube made by the present method can be formed with its radially measured wall thicknesses taken along a vertical plane thicker than the radially measured wall thicknesses taken along a horizontal plane. This enables the tubular axle to accommodate the heavier forces which are generally located in a vertical plane. The tube, having thinner wall sections, in the horizontal plane, accommodates the lesser forces applied in the generally horizontal plane. Consequently, the overall weight of the tube can be reduced by reducing the amount of metal used in the generally horizontal plane areas, where the loads are less than those applied in the generally vertical plane.

The process manufactures such a tube by forming a substantially elliptical, in cross-section, interior wall. Thus, cross-sectional thickness of the wall of the tube varies from thicker to thinner and back again along each 90°, around the circumference of the tube.

The method of this present invention contemplates manufacturing such a tube, with the elliptical interior, by a substantially cold forming process. The process generally involves pushing a ring-like blank, in an axial direction, through a die having a constricted die throat. The blank is extruded through the die throat by the pushing force. During the pushing, varying diameter mandrel-like members are selectively arranged within the die throat. These members are spaced from the wall defining the die throat so that the blank is moved through the generally annular space formed between the members and the die throat. By providing a circular die throat and an elliptical, in cross-section, extension, the space through which the blank is extruded produces a tube with a circular exterior surface and an elliptical interior surface.

The process utilizes a punch or ram which is fitted, co-axially, into the die cavity and abuts the rear or trailing end of the blank for pushing the blank in an axial direction through the die throat. The punch is formed with one or more extensions which extend towards and fit within the die throat. Thus, as the punch moves towards the die throat, pushing the blank therethrough, its extensions are successively positioned within the die throat to provide the annular space through which the tube is extruded. By utilizing extensions of different diameter, which extensions may include one or more circular in cross-section shapes and at least one elliptical in cross-section shape, a finished tube may be provided which has portions that are provided with elliptical interior walls and portions which are provided with circular interior walls. The portions with the circular interior walls may be thickened, relative to the other portions of the tube, to provide material for machining or welding or the like as required to complete the construction of an axle or a similar type of tube.

An object of this invention is to provide a method for producing axle type tubes which have interior wall portions that are elliptical in cross-section and coaxially arranged relative to a circular exterior wall and which may also have portions which are provided with circular interior walls, with the process being relatively inexpensive to perform.

A further object of this invention is to provide a process for manufacturing tubes whose cross-sectional wall thickness may vary within selected portions of the tube, without materially increasing the cost of manufacturing such type tubes.

Still another object of this invention is to provide a method for manufacturing tubes whose weights are reduced by reducing the wall thicknesses at selected portions.

An overall objective is to utilize a cold forming extrusion process for manufacturing tubes having interior wall portions which are substantially elliptical or, otherwise non-circular, in shape to thereby provide thinner and thicker cross-sectional wall sections, without materially increasing the expense or the time or changing procedures used in manufacturing uniform wall thickness type tubes.

These and other objects and advantages of this invention will become apparent upon reading the following description, of which the attached drawings form a part.

DETAILED DESCRIPTION

Figure 1:
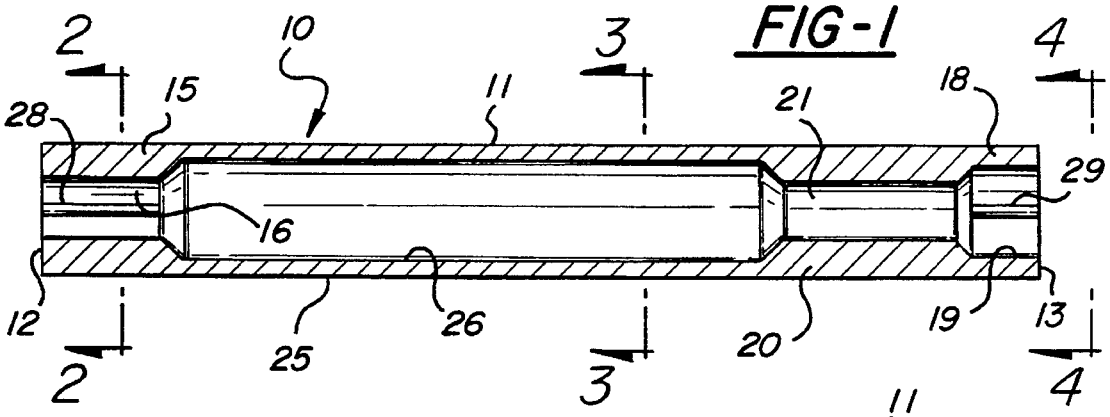
FIG. 1 is a cross-sectional, elevational view of an axle tube formed by the process herein.

Referring to the drawings, FIG. 1 illustrates a tube 10 which may be used to form a vehicle axle. By way of example, the tube may be further processed to form a completed axle following the disclosure in U.S. Pat. No. 4,435,972 issued Mar. 13, 1984 to Joseph A. Simon for a "Process for Forming Integral Spindle-Axle Tubes". The method of the present application relates to forming the tube to the point illustrated in FIG. 1.

The tube 10 has a substantially circular exterior wall 11 and opposite ends which, for purposes of description, are designated as a lead end 12 and a trailing end 13.

The lead end 12 is formed with a wall portion 15 that is thicker in cross-section than the central portion which will be described further. Thus, the wall portion 15 has an interior circular wall surface 16. The trailing end 13 is formed with a trailing end portion 18 which has an interior, substantially circular wall 19 that has a diameter that is the same as the interior wall diameter of the lead end wall portion 15.

Preferably, the tube is also formed with an intermediate, thicker wall portion 20 which has a substantially circular interior wall 21. The radial thickness of the wall defining portion 20 is greater than the radial thickness of the lead end portion 15.

An elongated central portion 25 is formed between the intermediate portion 20 and the lead end portion 15. This central portion is formed with a substantially elliptical, in cross-section, shaped interior wall surface 26. The term "elliptical" as used here, in general, refers to a substantially elliptical or other non-circular shape by which the radial wall thickness of the central portion varies, as will be described further.

In addition, radially inwardly extending beads or ridges 28 and 29 may be integrally formed on the walls 16 and 19 of the lead and trailing end portions 15 and 18.

As an example, the overall tube length may be approximately 24 inches and the tube may be formed of a type of steel which is suitable for use in a truck axle. The wall thicknesses, that is, the radially measured wall thicknesses, can vary considerably depending upon the desired strength and size required for a particular axle.

Figure 2:
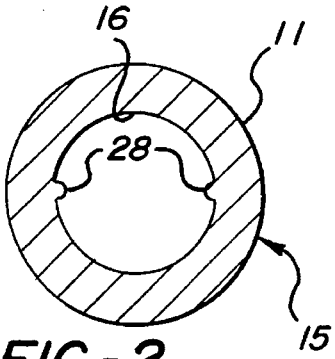
FIG. 2 is an enlarged, cross-sectional view taken in the direction of arrows 2—2 of FIG. 1.
Figure 3:
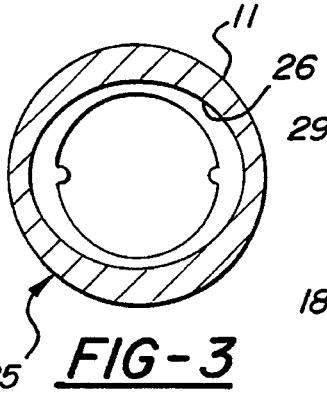
FIG. 3 is an enlarged, cross-sectional view taken in the direction of arrows 3—3 of FIG. 1.

As illustrated in FIG. 2, the tube has a uniform, relatively thick, wall at the lead end, as shown in FIG. 2. In the central portion as shown in FIG. 3, the wall thickness varies due to the generally elliptically shaped interior wall surface. Thus, measured in the vertical diametrical direction, the wall is thicker at the top and bottom than it is along the opposite sides in horizontal diametrical direction. That is, the wall, at the upper portion, is of a predetermined thickness, which is designed to be thick enough to handle the anticipated loads on the tube, and then gradually becomes thinner until the horizontal 90° offset plane is reached. At that point the wall gradually thickens until it reaches the bottom, vertical plane. The gradual change in wall thickness repeats towards the next 90° plane and the following 90° vertical plane.

The finished tube, when appropriately arranged in a vehicle, is able to accommodate heavy loads by having its thicker portions properly oriented. For example, the thinner wall portions may be oriented in a horizontal plane and its thicker portions may be oriented in a vertical plane as shown in FIG. 3. The result is that the tube may be substantially reduced in weight because of the reduction in the amount of material needed to accommodate a lower anticipated load.

Figure 4:
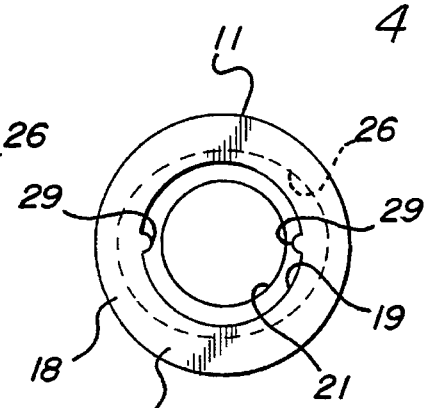
FIG. 4 is an end view, taken in the direction of arrows 4—4 of FIG. 1.
Figure 5:
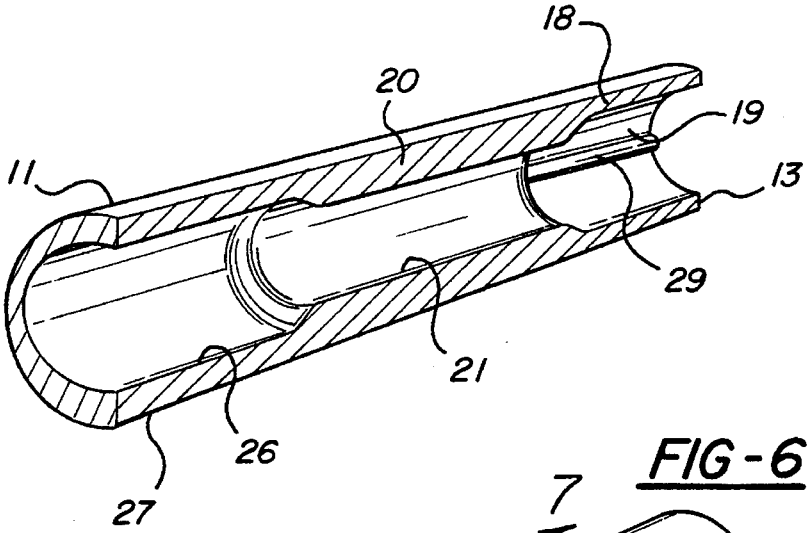
FIG. 5 is an enlarged, perspective, fragmentary, cross-sectional view showing a portion of the tube.

Referring to FIGS. 2 and 4, the end portions of the tube may be provided with beads 28. These may assist in properly orienting the tube so that the tube central portion is oriented for the anticipated loads. The beads may be arranged in the horizontal or vertical diametric planes or anywhere in between, depending upon the particular design.

Figure 8:
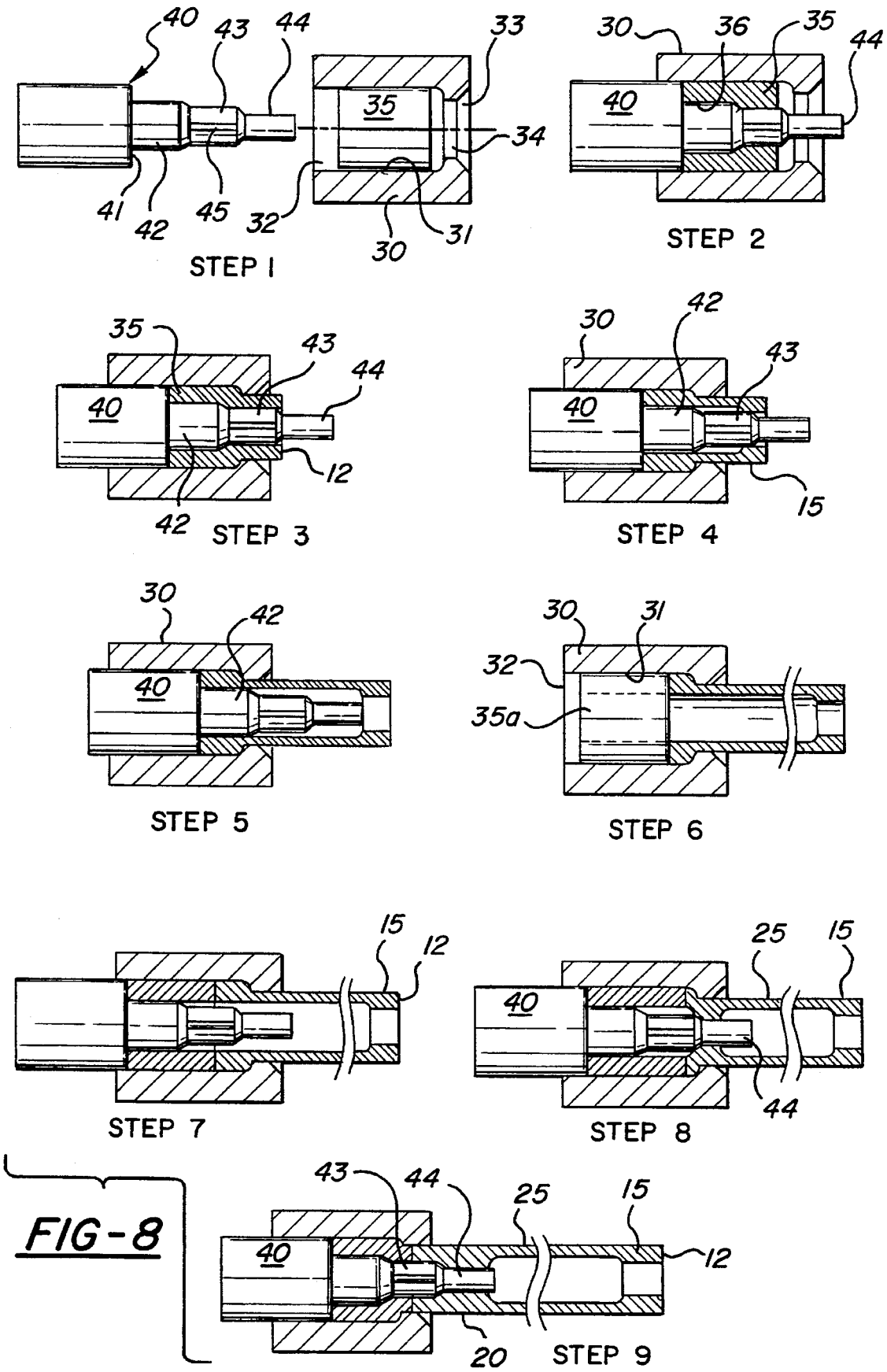
FIG. 8 schematically shows the sequence of steps in the performance of the process for manufacturing the tubes.

The process for manufacturing the tube is schematically shown in the sequence of steps illustrated in FIG. 8. The drawing of FIG. 8 schematically illustrates a die 30 having a die cavity 31. The die cavity has an entry end 32 and an exit or outlet end 33. A constricted die throat 34 is formed at the outlet end 33. This die throat preferably is substantially circular in cross-section.

A ring-like metal blank 35, which may be made of a suitable steel material, is inserted in the die cavity 31 through the entry end 32 of the die. This is illustrated in step 1. The blank 35 is in the form of a short tube having an interior wall 36.

Figure 6:
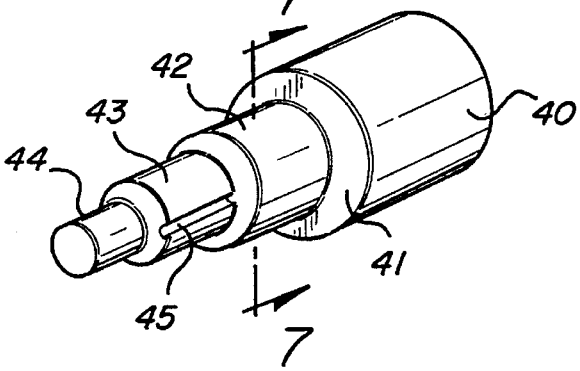
FIG. 6 is a schematic view showing the punch in perspective.
Figure 7:
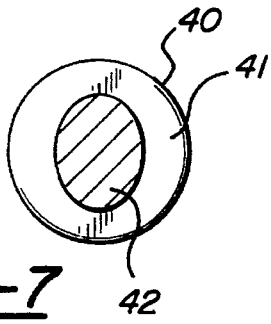
FIG. 7 is a schematic, cross-sectional view taken in the direction of arrows 7—7 of FIG. 6.

The blank is pushed through the die and the die throat by a punch or ram 40. This punch is schematically illustrated, in a perspective view, in FIG. 6. It includes an annular shoulder or ram face 41 and a series of axially aligned extensions. For illustration purposes, three extensions are shown. Thus, the first or rear extension 42, is coaxial with and extends forwardly of the annular shoulder 41. This extension, as illustrated in FIG. 7, is substantially elliptical in cross-section.

A second or middle extension 43 extends coaxially from the first or rear extension 42. Next, a third or forward extension 44, which is of a smaller diameter than the preceding extensions, extends from the second extension. The second or middle extension may be provided with a pair of grooves 45 for forming the beads 25 and 29. The number of grooves may be varied, depending upon the number of interior beads or ridges which are desired in the finished tube.

Turning back to FIG. 8, step 2 illustrates the punch inserted within the die 30 with its extensions located coaxially within the interior of the blank. The first or rear extension 42 has an outer circumference which is generally close in cross-sectional size to the interior diameter of the interior wall 36 of the blank and, also, is less than the inner diameter of the die throat 34.

Step 3 schematically illustrates the punch moving in the direction of the die throat so that its second or middle extension is arranged within the die throat. This forms an annular space between the die throat and the punch middle extension. The extrusion of the metal blank through the annular space forms the tube lead end 12.

Further movement of the punch, in the direction of the die throat, is illustrated in step 4 where the first or rear extension 42 is positioned within the die throat. This forms an annular shape which is approximately circular on its outer circumference and approximately elliptical on its inner circumference.

Because of the varying cross-sectional shape of the space through which the metal is extruded, the central portion of the tube is formed with a substantially circular exterior and a substantially elliptical interior wall surface.

Next, the punch or ram continues moving towards the die throat, as shown in step 5. When the blank is nearly pushed through the die throat, the punch movement is stopped. Then the punch is removed and a new blank 35*a* is inserted within the die cavity, as shown in step 6. The new blank engages, in end to end contact, the trailing portion of the partially extruded first blank 35.

The punch is replaced, as shown in step 7, and again is moved toward the die throat. Thus, the lead end of the second blank acts as the ram face and engages the trailing end of the partially extruded first blank to continue the extrusion of the first blank. During the continued movement of the punch, the third or forward extension 44 is arranged within the die throat, as illustrated in step 8. This produces the intermediate thickened portion 20.

Lastly, as illustrated in step 9, the continued movement of the punch positions the second or middle extension 43 within the die throat to form the trailing end portion 18 of the tube. Thereafter, the finished tube is pushed through the die throat and removed. The cycle is repeated for successor blanks.

The steps in the forming process may be varied somewhat, by using less punch extensions or an additional punch extension. For example, the middle and forward punch extensions may be omitted and, therefore, the lead and trailing ends of the tube may be formed as thicker wall sections simply by collapsing, radially inwardly, the tubular blank as it passes through the die throat without a punch extension arranged within the die throat. An example of this is illustrated in the above-mentioned patent to Joseph A. Simon, U.S. Pat. No. 5,105,644 issued Apr. 21, 1992 for a "Light Weight Drive Shaft". In using a method similar to that disclosed in such patent, the punch extension is formed in an elliptical cross-sectional shape or something similar to that shape so as to provide the varying thickness central portion in the finished tube.

Significantly, the process of this invention produces the desired varying wall thickness tube relatively inexpensively, without materially increasing the time or expense required for forming a tube of uniform wall thickness. This invention may be further developed within the scope of the following claims. Accordingly, having disclosed at least one operative embodiment of the process of this invention, it is desired that the foregoing description be read as being illustrative of an operative embodiment of the invention rather than in a strictly limiting sense.

I now claim:

1. A method for forming a light weight axle such as used in an automotive vehicle, comprising the steps of:

positioning a tubular, metal blank having a lead end and a trailing end within an open ended tubular die having an entrance end into which the blank is inserted for positioning within the die, and having an outlet end formed as an annular, radially inwardly extending, die throat of a smaller diameter than the blank outer diameter, with the blank leading edge arranged at the throat for extrusion through the throat;

inserting into the die entrance end a punch having a leading end and a longitudinal extension extending from the punch leading end, and with said extension being substantially elliptical in cross-section, arranging the leading end against the trailing end of the blank, with the punch closely fitted within the die;

positioning said extension within the inner wall of the tubular blank at a distance away from the die throat towards the trailing end of the blank;

moving the punch into the die, towards the die throat, to push the lead end of the blank through the die throat so that the leading end portion of the blank contracts radially inwardly and extrudes longitudinally forwardly of the throat to form a tubular extruded section of predetermined length;

continuing moving the punch towards the die throat while positioning the punch extension within the die throat to form a space between the die throat and the punch extension; so that continued movement of the punch extrudes a portion of the blank through said space and forms that blank portion into a tubular shape having a substantially circular exterior surface and a substantially elliptically shaped interior surface;

continuing pushing the trailing end of the blank through the die throat to complete the extrusion of an elongated tube, at least a portion of which is provided with diametrically opposing thick wall sections and 90° offset diametrically opposing thin wall so that the axle may be oriented, in use, to correlate its thicker and thinner wall sections with the anticipated loads applied to the axle.

2. A process for extruding an axle tube for use in an automotive vehicle and the like, comprising the steps of:

positioning a tubular blank, in coaxial relationship, within an open ended, substantially circular die cavity having an inlet end through which the blank is inserted and an opposite extrusion end formed by an annular, inwardly extending, continuous shoulder providing a die extrusion throat through which the blank is extruded, and with the diameter of the throat being larger than the inner diameter of the tubular blank;

inserting a punch into the inlet end of the die, and with the punch having an annular shoulder positioned against the trailing end of the blank, that is, the end remote from the throat, and with the punch having a first punch extension closely fitted within the interior wall of the blank, and with the punch having a second extension of a smaller diameter than the blank interior extending through part of the blank and die throat, and having a third punch extension, which is coaxial with and extends from the first and second punch extensions, but is of a smaller diameter than the second punch extension, with the punch shoulder and punch extensions being coaxial with each other and with the blank and die throat, and with the first punch extension being elliptical in cross-section while the second and third extensions are substantially circular in cross-section;

moving the punch towards the die throat so that the punch shoulder pushes against the blank trailing end to force the blank leading end through the die throat, and simultaneously aligning the second punch extension within the die throat for extruding the lead end of the blank through the annular space located between said second punch extension and the die throat to form a forward, thickened end of a metal tube;

continuing moving the punch towards the die throat while aligning the first punch extension with the die throat to provide an annular space between the die throat and the first punch extension which space is substantially circular on its exterior and elliptical on its interior, and thereby extruding the blank through the space to form a relatively thin wall metal tube middle portion whose exterior wall surface is substantially circular and whose interior wall surface is substantially elliptical in cross-section;

removing the punch from the die before completely extruding the tubular blank through the throat, and inserting a second tubular blank within the die in end-to-end contact with the trailing end of the partially extruded blank;

reinserting the punch in the die with its punch shoulder engaging the trailing end of the second blank and engaging the lead end of the second blank against the trailing end of the first blank;

moving the punch towards the die throat, with the third punch extension positioned within the die throat to extrude a portion of the first, partially extruded blank, through the annular space between the die throat and third punch extension for forming a relatively thick wall, rear section adjacent the trailing end of the partially extruded first blank;

moving the punch further while moving the second punch extension within the die throat and the second blank pushes the remainder of the first, partially extruded, blank through the annular space between the second punch extension and the die throat to form an inwardly thickened end portion on the trailing end of the first blank and to also simultaneously extrude an inwardly thickened end portion on the leading end of the second blank;

removing the extruded first blank and continuing and repeating the foregoing steps on the second and successive blanks;

thereby forming a tube having a circular exterior wall and a thicker wall section at its forward, lead end, and a thicker wall section near, but spaced from, its trailing end and with the wall section between the two thicker wall sections being substantially elliptical in interior cross-section and substantially circular in exterior cross-section to form diametrically opposing thicker wall portions and 90° offset diametrically opposing thinner wall sections.

3. A process as defined in claim 2 and including forming a radially inwardly extending bead on the interior wall of the thicker wall section formed on the trailing end portion of the tube by providing at least one groove extending along the surface of the third extension into which groove metal is forced during the time that the third extension is arranged within the die throat.

4. A process for extruding a tubular axle comprising the steps of:

positioning a tubular metal blank within an open ended, substantially circular die cavity having an inlet end into which the blank is inserted and an opposite constricted die throat end through which the blank is extruded, with the throat diameter being larger than the inner diameter of the tubular blank;

inserting a punch into the die inlet end, with the punch closely fitted within the die cavity and with the die having an annular shoulder engaged against the trailing, free end of the blank, and with the punch having a non-circular in cross-section, such as a substantially elliptical cross-section, punch extension closely fitted within the interior wall of the tubular blank;

moving the punch towards the die throat so that the punch shoulder pushes the blank towards the die throat and simultaneously aligning the punch extension within the die throat, to form an annular space between said punch extension and the die throat;

extruding the blank through the space between the die throat and the punch extension to form the extruded portion of the blank into an annular shape whose exterior wall is substantially circular and whose interior wall is substantially elliptical in cross-sectional shape;

stopping the punch movement before completely extruding the trailing end portion of the blank through the die throat;

removing the punch from the die cavity and inserting a second tubular blank within the die cavity in end-to-end contact with the trailing end of the partially extruded blank;

pushing the trailing end of the second blank towards the die throat to complete the extrusion of the first blank and to form an elongated tubular axle.

5. A process for extruding a tubular axle, comprising the steps of:

positioning a tubular metal blank within an open ended die having an inlet end through which the blank is inserted and an opposite extrusion end formed by a die throat whose throat diameter is larger than the interior diameter of the tubular blank;

moving the blank into and through the die extrusion throat by a punch which is closely fitted within the die and which has an annular surface engaging against the trailing end of the blank and with the punch having a first punch extension that is closely fitted within the interior wall of the blank and is substantially elliptical in cross-section, and having a second, integral, punch extension extending towards the die throat within the blank, with the second extension being substantially circular in cross-section and of a smaller diameter than the first extension;

arranging the second die extension within the die throat as the blank is moved towards the die throat for extruding a portion of the blank through the annular space between the second die extension and the throat to thereby form a relatively thick wall tubular portion;

continuing moving the blank through the extrusion die throat while positioning the first punch extension within the die throat to thereby form a portion of the tube with a circular exterior shape and an elliptical interior wall shape;

completing moving the blank through the die throat and removing the extruded tube therefrom.

6. A process as defined in claim 5 above, and including the steps of stopping the movement of the blank through the die throat before the extrusion is completed and removing the punch and inserting a second blank within the die in end-to-end contact with the first blank;

moving the second blank towards the die throat for forcing the first blank completely through the die throat and completing the extrusion thereof.

* * * * *